US007220930B2

(12) United States Patent
Gordon et al.

(10) Patent No.: US 7,220,930 B2
(45) Date of Patent: May 22, 2007

(54) FLOOR CARE APPLIANCE WITH AN ELECTRO LUMINESCENT SWITCH PANEL

(75) Inventors: Evan A. Gordon, Canton, OH (US); Aaron P. Tondra, North Canton, OH (US)

(73) Assignee: The Hoover Company, North Canton, OH (US)

( * ) Notice: Subject to any disclaimer, the term of this patent is extended or adjusted under 35 U.S.C. 154(b) by 543 days.

(21) Appl. No.: 10/352,822

(22) Filed: Jan. 28, 2003

(65) Prior Publication Data

US 2004/0144633 A1 Jul. 29, 2004

(51) Int. Cl.
*H01H 9/00* (2006.01)

(52) U.S. Cl. ..... 200/311; 200/313; 15/339; 362/30; 341/22

(58) Field of Classification Search ..... 200/310–317; 15/339, 319, DIG. 10, DIG. 11; 362/26–31; 341/20–22; 345/170
See application file for complete search history.

(56) References Cited

U.S. PATENT DOCUMENTS

| | | | | |
|---|---|---|---|---|
| 3,315,111 | A * | 4/1967 | Jaffe et al. | 313/503 |
| 4,262,182 | A | 4/1981 | Basler et al. | 200/314 |
| 4,500,173 | A * | 2/1985 | Leibowitz et al. | 349/69 |
| 4,683,360 | A * | 7/1987 | Maser | 200/314 |
| 5,507,067 | A | 4/1996 | Hoekstra et al. | 15/319 |
| 5,542,146 | A | 8/1996 | Hoekstra et al. | 15/319 |
| 5,670,776 | A | 9/1997 | Rothbaum | |
| 5,836,671 | A | 11/1998 | Chien | |
| 5,876,108 | A | 3/1999 | Chien | |
| 5,947,580 | A | 9/1999 | Chien | |
| 6,072,198 | A * | 6/2000 | Sun et al. | 257/103 |
| 6,183,101 | B1 | 2/2001 | Chien | |
| 6,217,183 | B1 * | 4/2001 | Shipman | 362/30 |
| 6,467,924 | B2 * | 10/2002 | Shipman | 362/600 |
| 6,590,508 | B1 * | 7/2003 | Howell et al. | 341/22 |

(Continued)

FOREIGN PATENT DOCUMENTS

| | | |
|---|---|---|
| DE | 9107297.2 | 5/1973 |

(Continued)

OTHER PUBLICATIONS

Photograph of Dirt Devil Platinum Force Upright Extractor Released Apr. 2001.

(Continued)

*Primary Examiner*—Kyung Lee
(74) *Attorney, Agent, or Firm*—A. Burgess Lowe, Esq.; Michael J. Corrigan, Esq.

(57) ABSTRACT

A floor care appliance such as a vacuum cleaner is provided having a display panel having at least one indicator light for indicating a status of a feature of the appliance wherein the indicator light is lighted by electro luminescent lighting. The electro luminescent lighting is also used on a control panel for a floor care appliance to backlight one or more switches used to control a feature or mode of the appliance wherein the backlighting indicates a status of the feature or mode associated with a particular switch. The switches and electro luminescent backlighting are embedded between layers of a thin film allowing the display and control panels to be mounted on a curved surface such as the handle of the floor care appliance.

18 Claims, 9 Drawing Sheets

U.S. PATENT DOCUMENTS

| | | | | |
|---|---|---|---|---|
| 6,936,783 | B2 * | 8/2005 | Kawaguchi et al. | 200/314 |
| 2001/0037933 | A1 * | 11/2001 | Hunter et al. | 200/310 |
| 2002/0092115 | A1 | 7/2002 | Zahuranec et al. | 15/320 |
| 2002/0092116 | A1 | 7/2002 | Zahuranec et al. | 15/320 |
| 2002/0092122 | A1 | 7/2002 | Zahuranec et al. | 15/352 |
| 2004/0144633 | A1 * | 7/2004 | Gordon et al. | 200/308 |

FOREIGN PATENT DOCUMENTS

| | | | |
|---|---|---|---|
| EP | 0 134 979 | | 6/1984 |
| EP | 847066 | A2 | 10/1998 |
| GB | 2153078 | A | 8/1985 |
| GB | 2243992 | A | 11/1991 |
| JP | 09027232 | | 1/1997 |
| WO | WO 00/55879 | | 9/2000 |

OTHER PUBLICATIONS

Photograph of Dirt Devil Platinum Force Upright Extractor (2nd Page).

Photograph of Polti Vaporetto Model No. 3000 Portable Steam Cleaner Released Apr. 2001.

Photograph of Polti Vaporetto M del No. 2001R Released Apr. 2002.

* cited by examiner

FLOOR CARE APPLIANCE WITH AN ELECTRO LUMINESCENT SWITCH PANEL

BACKGROUND OF THE INVENTION

1. Field of the Invention

This invention relates to controls and in particular to a display panel for a floor care appliance having at least one indicator light for indicating a status of an operational feature of the appliance wherein the indicator light is electro luminescent lighting. In another embodiment of the invention, the electro luminescent lighting is used to backlight at least one switch used to control an operational feature of the appliance wherein the backlighting indicates a status of the operational feature associated with a particular switch.

2. Summary of the Prior Art

Floor care appliances are well known in the art. Typical floor care appliances include upright vacuum cleaners, canister vacuum cleaners, hard floor cleaners, and extractors. It is known to provide floor care appliances with one or more indicator lights to indicate a status or mode of a particular operational feature which may or may not be combined with an associated switch for lighting the switch to show the status of the operational feature. Many floor care appliances have a switch for controlling a mode of the appliance including the speed of the suction motor, agitator motor, nozzle height, etc. Some of these cleaners have an indicator light to display the status of these features located on a panel on the handle or other conspicuous area on the appliance. The indicator light may be combined with an associated switch to indicate the status of the appliance with respect to the position of the switch.

An example of such a floor care appliance can be found in U.S. Pat. No. 4,252,182 issued to Basler which provides an electronic control system for a vacuum cleaner that has two user-selectable bag change modes. In a maximum suction bag change mode, the electronic control system of vacuum cleaner will shut off the vacuum cleaner when the vacuum cleaner bag has filled and the suction power of the unit has been degraded as a result. If the maximum fill bag change mode is selected, the electronic control system will shut off the vacuum cleaneronly afterthe bag has filled to the maximum extent allowable. The control system has indicator lights to display to the user whether the maximum suction or the maximum fill mode has been selected. The control system also has an optical dust sensor based on one-piece lens units located in the vacuum cleaner handle for monitoring the frequency with which dust particles flow into the vacuum cleaner. The control system can automatically adjust the power setting of the vacuum cleaner based on the measured frequency.

However, it is heretofore unknown to use electro luminescent lighting on a floor care appliance to indicate the status or mode of an appliance operational feature. It is also unknown to use electro luminescent lighting for lighting an associated switch to show the status or mode of the operational feature. Most floor appliance lighting indicators use an ordinary light bulb or light emitting diode (LED) for indicator and/or switch lighting. The electro luminescent lighting provides a stylish and readily adaptable source of lighting for indicating the status or mode of various operational features of a floor care appliance when used as solely as an indicator or in combination with an associated switch. Therefore, the present invention fulfills a need not found in the prior art.

Accordingly, it is an object of the invention to provide an improved floor care appliance having one or more mode indicator lights lighted by electro luminescent lighting.

It is a further object of this invention to provide an improved floor care appliance having one or more switches to control a mode or operational feature of the appliance wherein the switches are backlighted by electro luminescent lighting when the associated mode or operational feature is enabled.

It is yet further an object of this invention to provide an improved floor care appliance having one or more switches to control a mode or operational feature of the appliance wherein the switches are backlighted by electro luminescent lighting when the associated mode or operational feature is enabled and wherein the one or more switches are embedded in at least two layers of a film and are surrounded by an electro luminescent field.

It is yet still a further object of this invention to provide an improved floor care appliance having one or more switches to control a mode or operational feature of the appliance wherein the switches are backlighted by electro luminescent lighting when the associated mode or operational feature is enabled and wherein the one or more switches are of the capacitive sensing type.

It is a further object of this invention to provide an improved floor care appliance having one or more switches to control a mode or operational feature of the appliance wherein the switches are backlighted by electro luminescent lighting when the associated mode or operational feature is enabled and wherein the one or more switches can be mounted on a curved surface such as the handle of the floor care appliance.

It is yet a further object of this invention to provide a flexible sheet having one or more electrical switches each being backlighted by an associated electro luminescent light embedded between adjacent layers of a film wherein the electrical switches controls a machine function and the sheet can be mounted on a flat, non-flat, curved, contoured, or other surface.

SUMMARY OF THE INVENTION

In the preferred embodiment of the invention, a display panel for a floor care appliance is provided having a plurality of indicator lights for indicating the status or mode of a particular operational feature of the appliance when enabled wherein only one mode can be enabled at a time. The indicator lights are lighted by electro luminescent lighting and each light is covered by a semi-transparent lens which is labeled with the particular mode. A single slide switch in combination with a microprocessor is used to toggle the appliance between successive modes. Examples of the various floor care appliance modes or operational features include turning the suction motor on and off, adjusting the speed of the suction motor, turning the agitator on and off, adjusting the height of the suction nozzle, dispensing of cleaning solution, and/or level of cleaning solution in the solution reservoir.

In a second embodiment of the invention, a display panel for a floor care appliance is provided having a plurality of indicator lights for indicating when a particular mode or operational feature of the appliance is enabled wherein more than one mode can be enabled at a time. The indicator lights are lighted by electro luminescent lighting and each light is covered by a semi-transparent lens. A switch is associated with each of the indicator lights for controlling the associated mode or operational feature. The indicator light is lighted when the associated mode or operational feature is enabled. Examples of the various floor care appliance modes or operational features include turning the suction motor on and off, adjusting the speed of the suction motor, turning the agitator on and off, adjusting the height of the suction nozzle, dispensing of cleaning solution, and/or level of cleaning solution in the solution reservoir.

In a third embodiment of the invention, the electro luminescent lighting is used to backlight at least one switch used to control an operational feature of the appliance wherein the backlighting indicates a status of the operational feature associated with a particular switch. The switch or switches are formed partially from layers of film with opposing contacts embedded in adjacent layers of film. Each switch is surrounded by an electro luminescent field that glows when the mode or operational feature the switch controls is enabled. Each switch is connected to a microprocessor senses when the switch is pressed and the opposing contacts momentarily meet. The microprocessor in turn either turns the associated mode or operational feature on or off depending on the previous state of the mode. The microprocessor also controls the current flowing through the electro luminescent field and allows the current to flow when the switch turns the associated mode or operational feature on. The current and electro luminescent light remain on until the switch is pressed again the associated mode or operational feature is turned off.

In a fourth embodiment of the invention, a display panel for a vacuum cleaner such as an upright vacuum cleaner is provided having a plurality of indicator lights lighted by electro luminescent lighting for indicating when a particular mode or operational feature of the cleaner is enabled and one or more switches that are backlighted by electro luminescent lighting for indicating when a particular mode or operational feature of the cleaner controlled by the switch is enabled. Cleaner modes or operational features that can be controlled by switches backlighted by electro luminescent lighting or having an indicator light lighted by electro luminescent lighting include height of the suction nozzle, the agitator being turned on or off, the type of floor being cleaned, i.e., bare floor or carpeting, whether the self propelling feature is on or off, the suction mode being in quiet mode or automatic mode, and an electronic dirt finder indicating whether the surface being cleaned is clean or still dirty.

In a fifth embodiment of the invention, a display panel for a carpet cleaner such as an extractor is provided having a plurality of indicator lights lighted by electro luminescent lighting for indicating when a particular mode or operational feature of the cleaner is enabled and one or more switches that are backlighted by electro luminescent lighting for indicating when a particular mode or operational feature of the cleaner controlled by the switch is enabled. Cleaner modes or operational features that can be controlled by switches backlighted by electro luminescent lighting or having an indicator light lighted by electro luminescent lighting include the cleaning mode, i.e. wash, rinse or auto, the agitator being turned on or off, the type of floor being cleaned, i.e., bare floor or auto, heated cleaning being on or off, the suction mode being in maximum, quiet, or off, and a moisture sensor for detecting and indicating if the floor surface is dry or wet.

In a sixth embodiment of the invention, a display panel for a bare floor cleaning machine is provided having a plurality of indicator lights lighted by electro luminescent lighting for indicating when a particular mode or operational feature of the cleaner is enabled and one or more switches that are backlighted by electro luminescent lighting for indicating when a particular mode or operational feature of the cleaner controlled by the switch is enabled. Cleaner modes or operational features that can be controlled by switches backlighted by electro luminescent lighting or having an indicator light lighted by electro luminescent lighting include the cleaning mode, i.e. wet or dry, the agitator being turned on, off, or gentle, heated cleaning being on or off, the suction mode being in maximum, quiet, or off, and a moisture sensor for detecting and indicating if the floor surface is dry or wet.

In a seventh embodiment of the invention, an electrical switch and an electro luminescent light are embedded in layers of film to form a flexible sheet that can be mounted on a flat, curved or other non-flat surface. The electroluminescent light can be used to backlight the switch to represent that the function or operational feature the electrical switch is controlling is energized. Alternately, electro luminescent light can be used to backlight the switch to represent that the function or operational feature the electrical switch is controlling is de-energized. A plurality of one or more electrical switches can be embedded in the flexible sheet each having an associated electro luminescent light.

BRIEF DESCRIPTION OF THE DRAWINGS

Reference may now be had to the accompanying drawings for a better understanding of the invention, both as to its organization and function, with the illustration being only exemplary and in which.

DETAILED DESCRIPTION OF THE INVENTION

Figure 1:
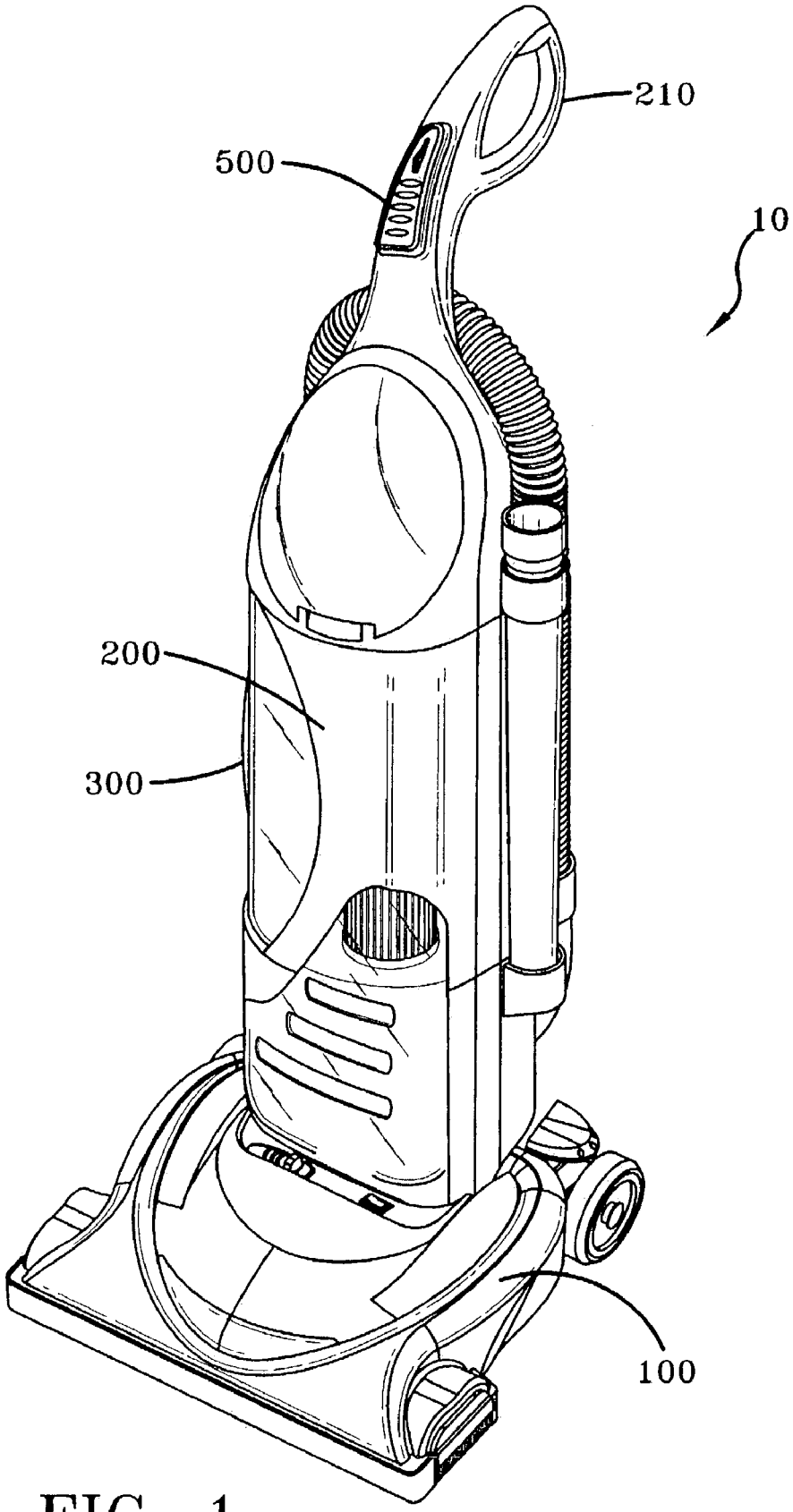
FIG. 1 is a perspective view of an upright vacuum cleaner having a control and display panel having one or more indicator lights lighted by electro luminescent lighting, according to the preferred embodiment of the invention.

Referring now to FIG. 1, shown is an upright vacuum cleaner 10 having a display panel 500 having a plurality of electro luminescent indicator lights 510–514 for indicating the status or mode of a particular operational feature of the cleaner 10 when enabled wherein only one mode can be enabled at a time, according to the preferred embodiment of the invention. Such an upright cleaner 10 typically has an upright portion 200 pivotally connected to a suction nozzle 100, a handle 210 at the distal end of the upright portion 200, a suction motor (not shown) fluidly connected to the suction nozzle 100, and a particle filtering and collecting arrangement 300 fluidly connected to the suction motor (not shown) and the suction nozzle 100 for filtering and collecting dirt particles. Display panel 500 is typically located on the front, curving face of handle 210 within easy reach of the vacuum cleaner 10 user. Although display panel 500 is shown on an upright vacuum cleaner display panel 500 could be installed on any other type of floor care or other appliance including a canister vacuum cleaner, bare floor cleaner, or an extractor without affecting the scope of the invention. The electro luminescent indicator lights 510–514 are formed by embedding an electrode layer and a electro luminescent phosphor layer in [thin] layers of film separated by an inner capacitive dieelectric layer. The construction of an electro luminescent light is detailed more fully hereinbelow and illustrated in FIG. 8. Electro luminescent lights embedded in layers of film are used as indicator lights or other purposes and are commercially available for purchase from suppliers such as Novatech Industries, Inc. of Skippack, Pa.

Figure 2:
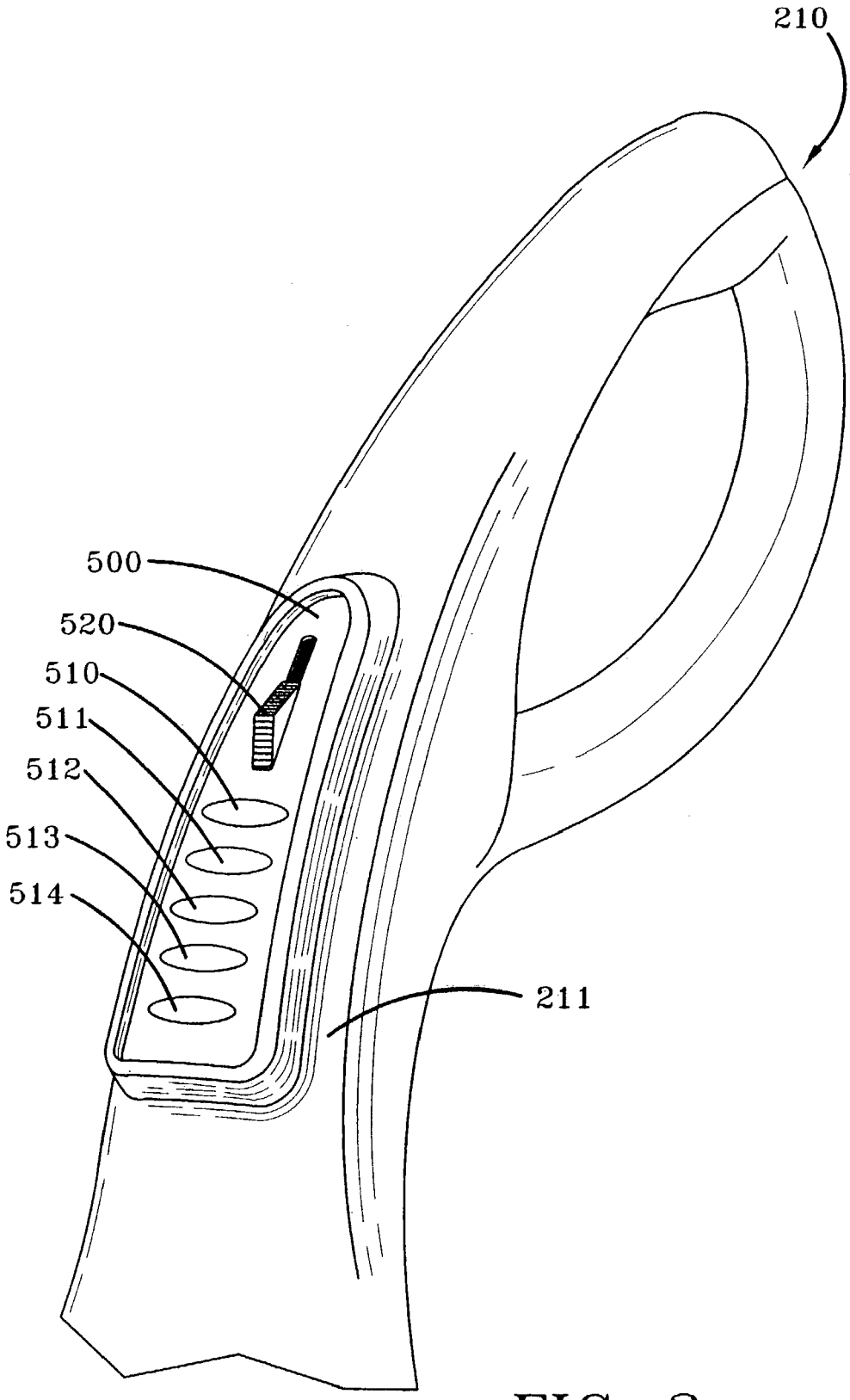
FIG. 2 is a partially cutaway enlarged view of cleaner handle for a floor care appliance such as the one shown in FIG. 1 having a control and display panel having one or more indicator lights lighted by electro luminescent lighting, according to the preferred embodiment of the invention.
Figure 9:
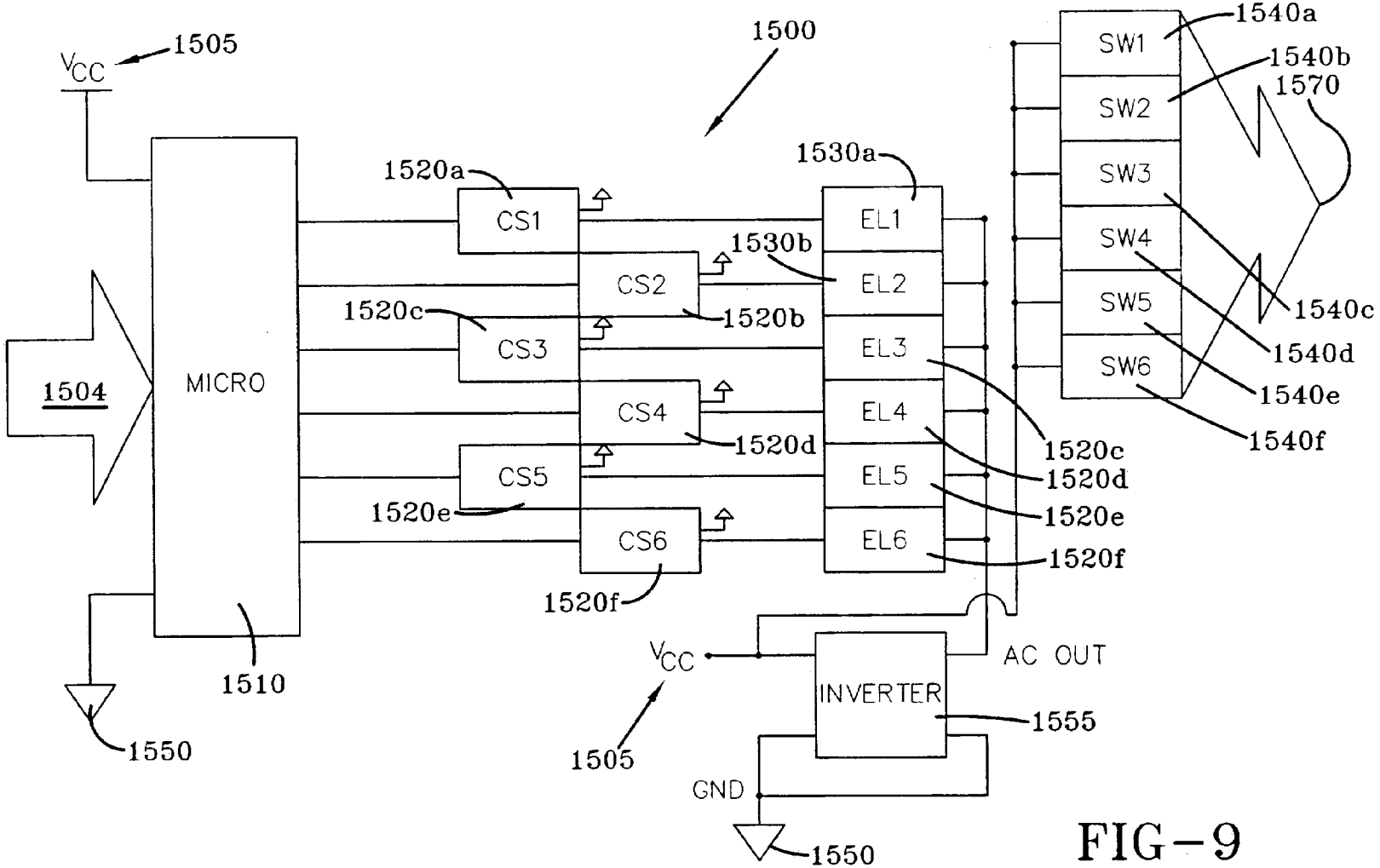
FIG. 9 is a schematic diagram of a circuit utilizing a microprocessor to control one or more features of a floor care appliance such as the one shown in FIG. 1 upon receiving an input from an associated switch and for lighting or extinguishing an associated electro luminescent light based upon the input from the switch, for use in the first through sixth embodiments of the present invention.

Referring now to FIG. 2, display panel 500 is mounted on the front, contoured face 211 of cleaner handle 210. The layers of film the electro luminescent indicator lights 510–514 are embedded between the layers of film to facilitate the mounting of the display panel 500 on a curved surface such as the curved face 211 of handle 210. Each electro luminescent indicator lights 510–514 may be covered by a semi-transparent lens of differing colors which may be labeled with the particular mode or cleaner operational feature the electro luminescent indicator light 510–514 is associated with. A single slide switch 520 in combination with a microprocessor 1510 such as the one shown in FIG. 9 is used to toggle the cleaner 10 between successive cleaner modes or operational features. Slide switch 520 is biased in the open position and upon application of a force will move to the closed position. Releasing the force will allow sliding switch 520 to return to the open position. Pressing slide switch 520 will cause the microprocessor 1510 (FIG. 9) to toggle the cleaner to the next successive mode. For example, with the cleaner initially off and no modes enabled, pressing slide switch 520 and releasing will cause the microprocessor 1510 (FIG. 9) to toggle cleaner 10 to the next mode, which could be turning the suction motor on at its highest speed, which will also cause indicator light 510 to illuminate. Pressing slide switch 520 again and releasing it will cause the microprocessor 1510 (FIG. 9) to toggle the cleaner to the next successive mode, which could be a medium suction motor speed, and cause the next successive indicator light 511 to light and extinguish the previous indicator light 510. Pressing slide switch 520 once again will cause the microprocessor 1510 (FIG. 9) to toggle cleaner 10 to the next mode, which could be turning the suction motor on at its lowest, which will also cause indicator light 512 to illuminate and extinguish the previous indicator light 511. Continued pressing and releasing slide switch 520 will cause the microprocessor 1510 (FIG. 9) to toggle to the next successive mode, cause the next successive indicator light to light, and then extinguish the previous indicator light, etc., until the cleaner has been toggled through all modes. The final pressing of slide switch 520 will toggle cleaner 10 to off so that no cleaner 10 modes are enabled and none of indicator lights 510–514 are lighted. Other cleaner 10 modes or operational features that could be controlled by display panel 500 include turning the agitator (not shown) on and off, or adjusting the height of the suction nozzle 100.

Figure 3:
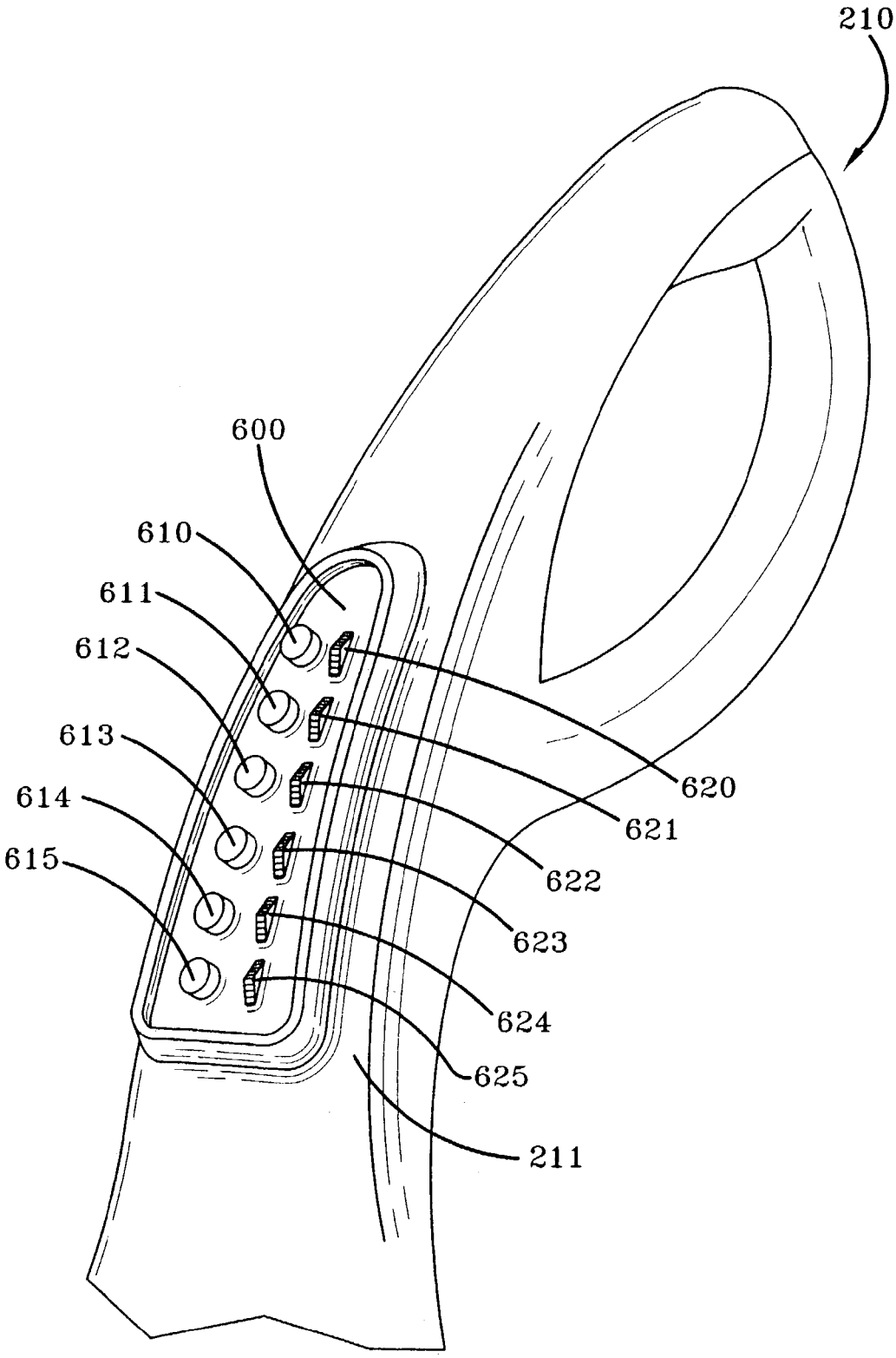
FIG. 3 is a partially cutaway enlarged view of cleaner handle for a floor care appliance such as the one shown in FIG. 1 having a control and display panel having one or more indicator lights lighted by electro luminescent lighting, according to the second embodiment of the invention.

Referring now to FIG. 3, shown is a display panel 600 for a floor care appliance such as the one shown in FIG. 1 having a plurality of indicator lights 610–615 for indicating when a particular mode or operational feature of the appliance is enabled wherein more than one mode can be enabled at a time, according to a second embodiment of the invention. The indicator lights 610–615 are lighted by electro luminescent lighting and each of indicator lights 610–615 are covered by a semi-transparent lens. Each of a plurality of switches 620–625 are associated with each of the indicator lights 610–615 for controlling the associated mode or operational feature. The indicator lights 610–615 are lighted when the associated mode or operational feature is enabled. Examples of the various floor care appliance modes or operational features that could be controlled by switches 620–625 and indicated by indicator lights 610–615 include turning the suction motor on and off, adjusting the speed of the suction motor, turning the agitator on and off, adjusting the height of the suction nozzle, dispensing of cleaning solution, and/or level of cleaning solution in the solution reservoir. The operation of the modes of the appliance 10 in conjunction with switches 620–625 and the associated electro luminescent indicator lights 610–615 may be controlled by a microprocessor 1510 such as the one shown on FIG. 9.

Figure 4:
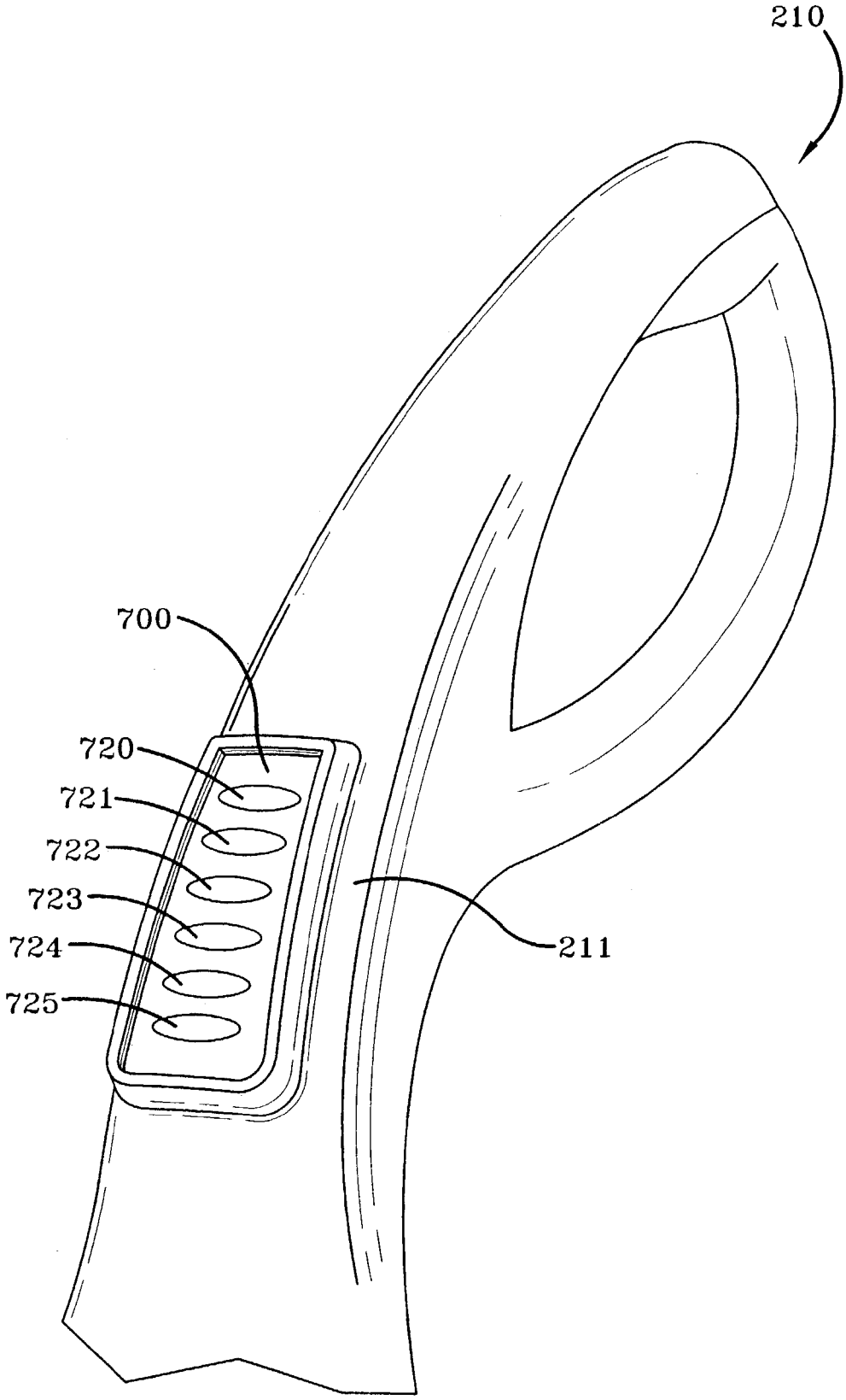
FIG. 4 is a partially cutaway enlarged view of cleaner handle for a floor care appliance such as the one shown in FIG. 1 having a control and display panel having one or more switches backlighted by electro luminescent lighting, according to the third embodiment of the invention.

Referring now to FIG. 4, shown is a display panel 700 mounted on the handle 210 of a floor care appliance, according to a third embodiment of the invention. The display panel 700 is comprised of a plurality of switches 720–725 used to control an operational feature or mode of the appliance wherein electro luminescent backlighting indicates the status of the operational feature or mode associated with a particular switch 720–725. The switches 720–725 are formed a pair of opposing contacts separated by a dielectric and embedded in layers of film. The switch embedded between layers of a film gives the switch the feeling when pressed of a "no touch" switch. The switch may also actually be a "no touch" or "capacitive sensing" type switch or other type of membrane switch without affecting the scope of the invention. Each of switches 720–725 are mounted above an associated electro luminescent light that lights when the mode or operational feature the switch 720–725 controls is enabled. Each of switches 720–725 are connected to a microprocessor 1510 like the one shown in FIG. 9 which senses when the switches 720–725 are pressed and the opposing contacts momentarily meet. The microprocessor 1510 (FIG. 9) in turn either turns the associated mode or operational feature on or off depending on the previous state of the mode. The microprocessor 1510 (FIG. 9) also controls the current flowing to the electro luminescent lights and allows the current to flow when switches 720–725 turn the associated mode on. The current and electro luminescent lighting remain on until the switch 720–725 is pressed again and the associated mode is turned off. The microprocessor 1510 (FIG. 9) may be programmed so that only one mode at a time may be enabled and the associated switch 720–725 lighted. The microprocessor 1510 (FIG. 9) may also be programmed so that more than one mode at a time may be enabled and the associated switch 720–725 lighted. A more detailed description of the operation of a microprocessor 1510 such as the one shown in FIG. 9 in conjunction with a plurality of switches and an associated electro luminescent light is detailed more fully hereinbelow.

Figure 5:
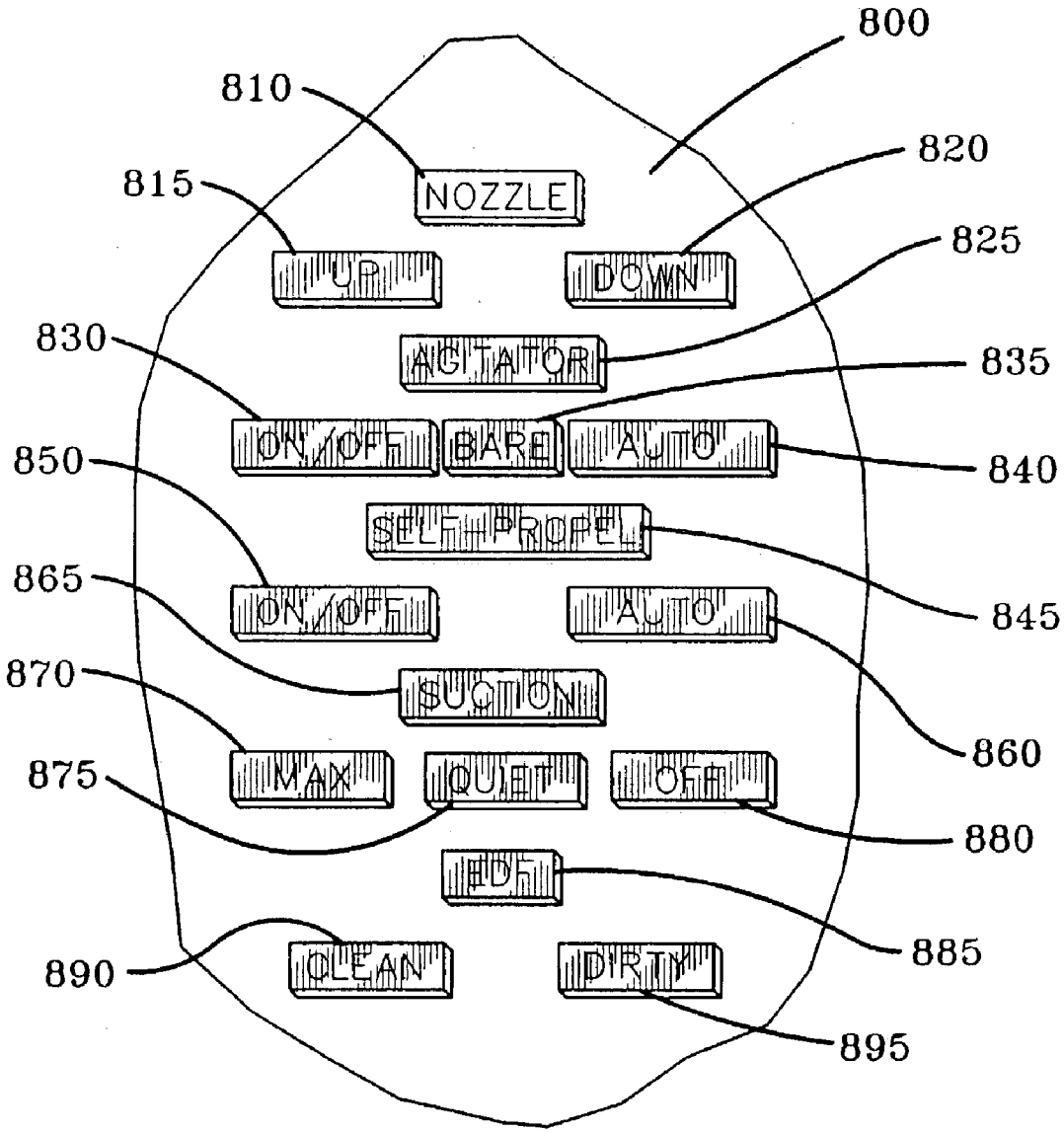
FIG. 5 is a partially cutaway enlarged view of cleaner handle for a floor care appliance such as a vacuum cleaner having a control and display panel having one or more switches backlighted by electro luminescent lighting, according to the fourth embodiment of the invention.

Referring now to FIG. 5, shown is a display panel 800 on the handle 210 of a floor care appliance such as a vacuum cleaner, according to the fourth embodiment of the invention. The display panel 800 includes a plurality of switches 815,820, 830,835,840,850,860,870,875, and 880 backlighted by electro luminescent lighting for indicating when a particular mode or operational feature of the cleaner is enabled. The display panel 800 also includes indicator lights 810,825,845,865,885,890 and 895 lighted by electro luminescence. The switches backlighted by electro luminescent lighting can include a suction nozzle height up switch 815 and a down switch 820, an agitator on/off switch 830, floor type switch 835, i.e. bare floor, or an automatic mode switch 840, a self propelling mode on/off switch 850 or automatic mode switch 860, suction mode selection switches for maximum suction mode 870, quiet mode 875 or off 880. Each of the aforementioned switches are backlighted by electro luminescence when the particular feature or mode being controlled is enabled. Indicator lights 810 and 885 are always lighted unless the appliance is turned off entirely. Indicator lights 825,845 and 865 are lighted when the associated function or operational features is turned on. Indicator lights 890 and 895 are lighted when the electronic dirt finder detects that the carpet is clean, or dirty, respectively. The operation of the appliance modes through the plurality of switches 815,820,830,835,840,850,860,870,875 and 880 backlighted by electro luminescent lighting and the plurality of indicator lights 810, 825, 845, 865, 885, 890 and 895 is controlled by a microprocessor 1500 such as the one shown in FIG. 9. described more fully hereinbelow.

Figure 6:
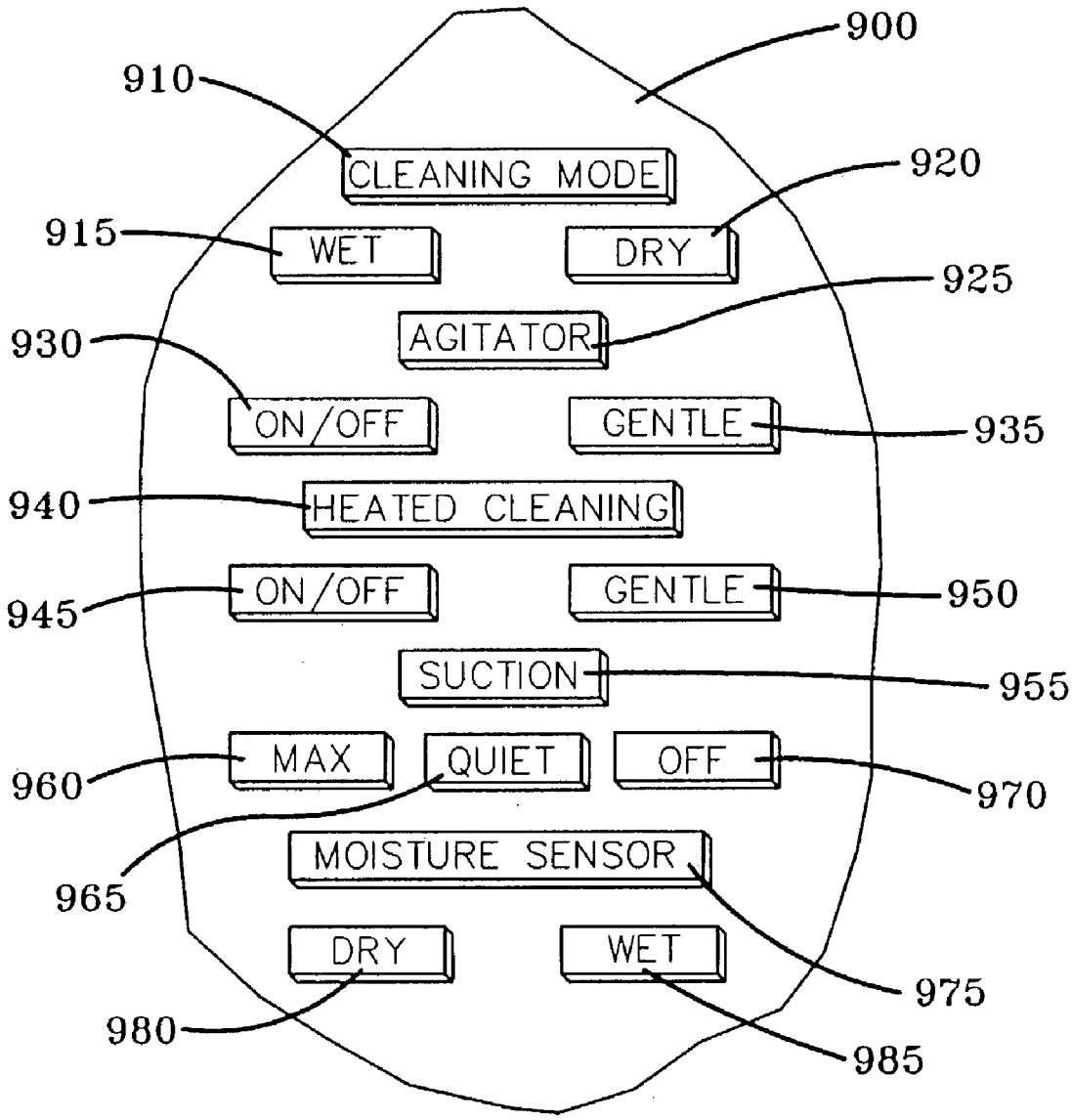
FIG. 6 is a partially cutaway enlarged view of cleaner handle for a floor care appliance such as an extractor having a control and display panel having one or more switches backlighted by electro luminescent lighting, according to the fifth embodiment of the invention.

Referring now to FIG. 6, shown is a display panel 900 located on the handle 210 of a floor care appliance such as an extractor, according to the fifth embodiment of the present invention. The display panel 900 includes a plurality of switches 915, 920, 930, 935,945,950,960,965 and 970 backlighted by electro luminescent lighting for indicating when a particular mode or operational feature of the cleaner is enabled. The display panel 900 also includes indicator lights 910,925,940,955,975,980 and 985 lighted by electro luminescence. Display panel 900 includes a switch 915 for selecting a wet cleaning mode, a switch 920 for selecting a dry cleaning mode, an on/off switch 930 and gentle switch 935 for an agitator mode, an on/off switch 940 and a gentle switch 950 for a heated cleaning mode, a maximum suction switch 960, a quite suction mode switch 965, and an off switch for the suction mode. There is an indicator light 980 for detecting a dry floor condition and an indicator light 985 for detecting a wet floor condition for a moisture sensor feature. Indicator lights 910 and 975 are always lighted unless the appliance is turned off entirely. Indicator lights 925, 940 and 955 are lighted when the associated function is turned on. The operation of the cleaner modes through the plurality of switches 915,920,930,935, 945,950,960,965 and 970 backlighted by electro luminescent lighting and the indicator lights 925, 940 and 955 lighted by electro luminescent lighting is controlled by a microprocessor 1500 such as the one shown in FIG. 9. described more fully hereinbelow.

Figure 7:
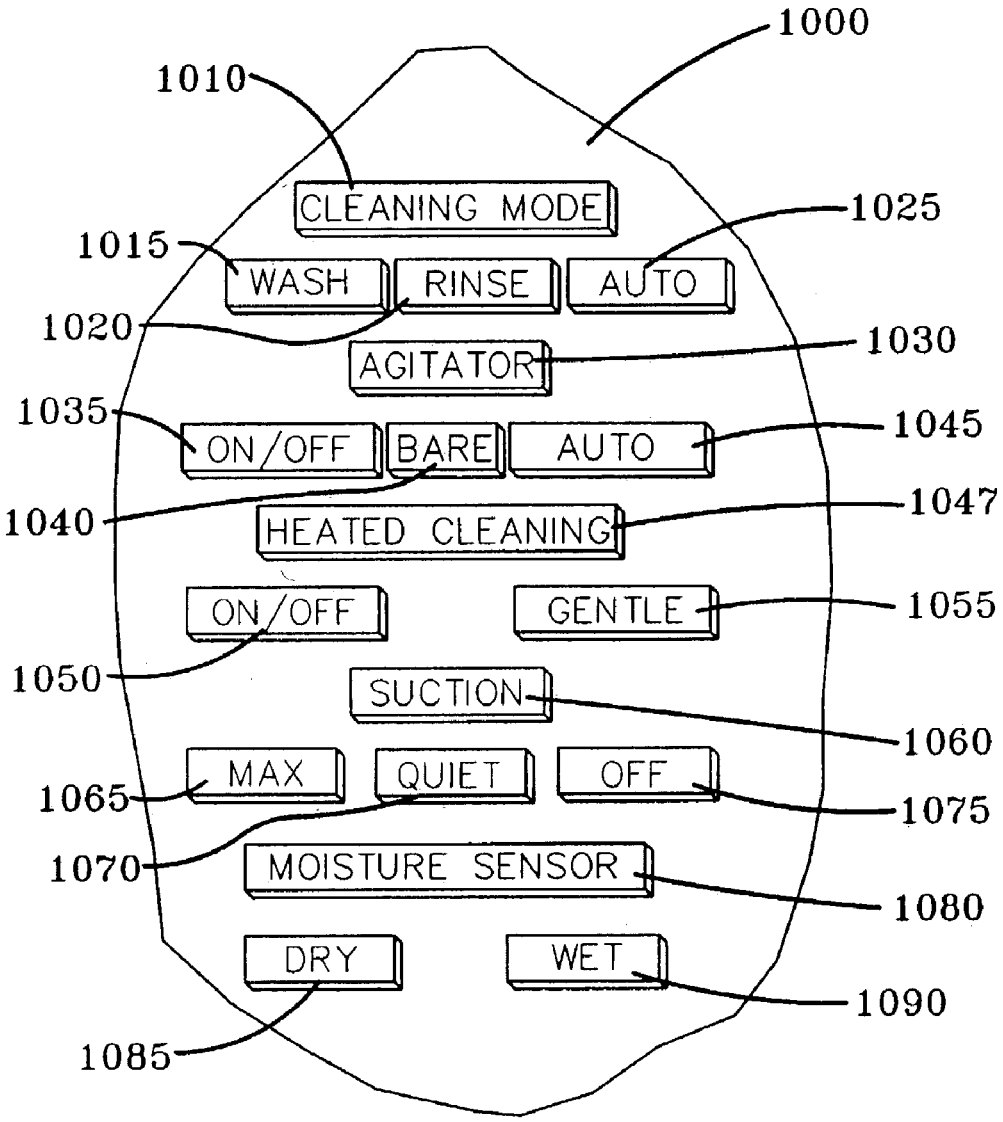
FIG. 7 is a partially cutaway enlarged view of cleaner handle for a floor care appliance such as a bare floor machine having a control and display panel having one or more switches backlighted by electro luminescent lighting, according to the fifth embodiment of the invention.

Referring now to FIG. 7, shown is a display panel 1000 for a floor care appliance such as a bare floor cleaning machine, according to the sixth embodiment of the present invention. The display panel 1000 includes a plurality of indicator lights 1010, 1030, 1047 and 1080 lighted by electro luminescent lighting for indicating when a particular mode or operational feature of the cleaner is enabled and a plurality of switches 1015, 1020, 1025, 1035, 1040, 1045, 1050, 1055, 1065, 1070 and 1075 that are backlighted by electro luminescent lighting for indicating when a particular mode or operational feature of the cleaner controlled by the switch is enabled. Switches for controlling various cleaner modes or operational features include a wash switch 1015, a rinse switch 1020 and an automatic mode switch 1025 for selection of the cleaning mode, an on/off switch 1035, a bare floor switch 1040, and an automatic mode switch 1045 for selection of the agitator mode, an on/off switch 1050, gentle mode switch 1055 for selection of the heated cleaning mode, a maximum suction switch 1065, a quiet suction switch 1070, and an off switch 1075 for selection of the suction mode. Indicator lights 1010 and 1080 are always lighted unless the appliance is turned off entirely. Indicator lights 1030, 1047 and 1060 are lighted when the associated function is turned on. Indicator lights 1085 and 1090 indicate a dry or wet floor condition, respectively, for the moisture sensor feature. The operation of the cleaner modes through the plurality of switches 1015, 1020, 1025, 1035, 1040, 1045, 1050, 1055, 1065, 1070 and 1075 and the indicator lights 1010, 1030, 1047 and 1080 are controlled by a microprocessor 1500 such as the one shown in FIG. 9. described more fully hereinbelow.

Figure 8:
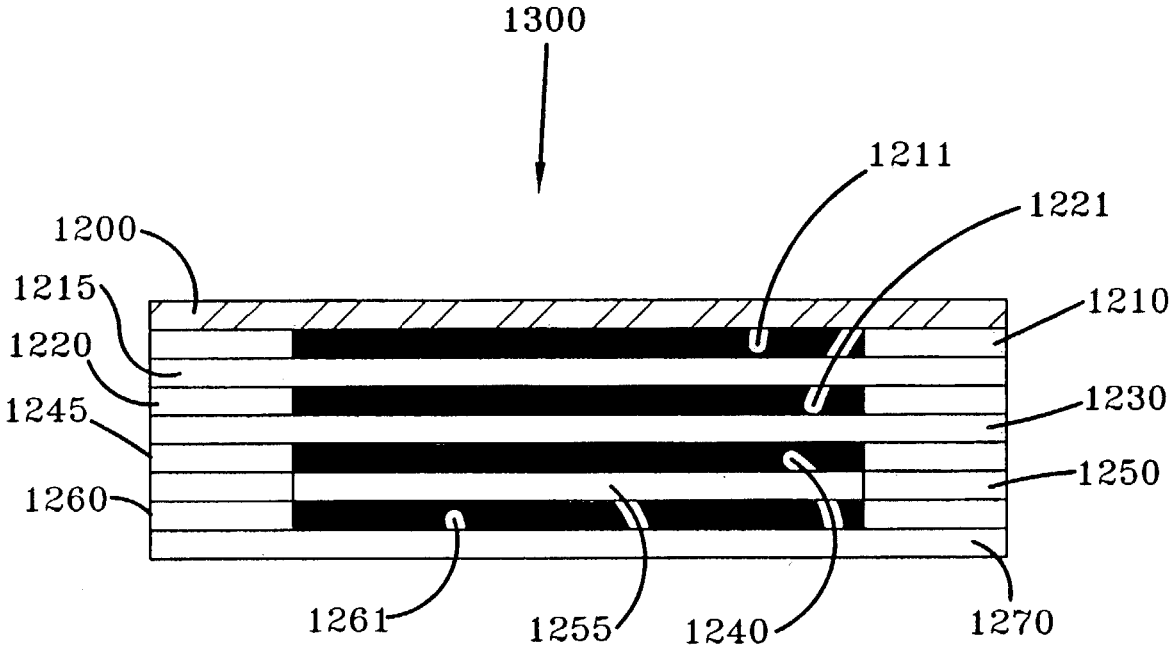
FIG. 8 is a cross-sectional side view of a film electrical switch and electro luminescent lighting arrangement utilized in the second through fifth embodiment embodiment of the invention.

The details of construction of a membrane switch such as the one described heretofore being backlighted by electro luminescent lighting is shown in FIG. 8. Such an electrical switch and electro luminescent light arrangement is especially conducive to mounting on a non-flat or curved surface on a machine including floor care or other appliances. There is virtually no limit to the number of applications it may be used for.

In the preferred embodiment, the layers comprising the electro luminescent light is physically located above the layers wherein the switch contacts are embedded. The arrangement includes substrate film layer 1200 which allows the electro luminescent light to pass therethrough. Beneath film layer 1200 is electro luminescent phosphor layer 1211 surrounded by a film layer 1210. Directly beneath film layer 1200 and electro luminescent phosphor layer 1211 is an inner capacitive dielectric layer 1215. Beneath dielectric layer 1215 is rear capacitive electrode layer 1221 which is surrounded on its periphery by an encapsulating dielectric layer 1220. Another encapsulating dielectric layer 1230 also sits beneath rear capacitive electrode layer 1221. Electrons from the current flowing from the rear capacitive electrode layer 1221 passing through the inner capacitive dielectric layer 1215 bombard the electro luminescent phosphor layer 1211 causing the phosphor to glow and produce light. The current flowing to the rear capacitive electrode layer 1221 is controlled by a membrane switch located in film layers 1240–1270 beneath rear capacitive electrode layer 1221. A first contact layer 1240 is located beneath dielectric layer 1230 is surrounded by a dielectric layer 1245. Directly beneath first contact layer 1240 is a dielectric layer 1255 comprised of a layer of air, other gas, or vacuum. Surrounding dielectric layer 1255 is a dielectric layer 1250 comprised of a film. Beneath dielectric layer 1255 is a second contact layer 1261 surrounded by a dielectric layer 1260. Beneath second contact layer 1261 and dielectric layer 1260 is an encapsulating dielectric layer 1270. Dielectric layer 1250 provides the support to form the dielectric layer 1255 between first contact layer 1240 and second contact layer 1261. A force in the direction of arrow 1300 on the outer surface of substrate 1200 is transmitted through layers 1200,1211,1215,1221,1230 to first contact layer 1240 which causes first contact layer 1240 to flex and pass through dielectric layer 1255 and make contact with second contact layer 1261. A microprocessor 1510 like the one shown in FIG. 9 is connected to first contact layer 1240 and second contact layer 1261 and detects when first contact layer 1240 contacts second contact layer 1261, even if only momentarily. The microprocessor 1510 (FIG. 9) is programmed to turn the current on to rear capacitive electrode layer 1221 to cause the electro luminescent phosphor layer 1211 to glow and give off light. The microprocessor 1510 (FIG. 9) is programmed to remember whether the current to rear capacitive electrode layer 1221 is on or off so that subsequent contact between first contact layer 1240 and second contact layer 1261 will turn the current off if the current was previously on or turn the current on if the current was previously off. The microprocessor 1510 (FIG. 9) can also be used to control an operational feature of the appliance associated with the switch/electro luminescent light arrangement wherein the electro luminescent light being on or off can be associated with a state or mode of an operational feature of the appliance 10.

Finally, shown in FIG. 9 is a block schematic diagram of an exemplary circuit utilizing a plurality of switches 1540A to 1540F for controlling a state or mode of a particular operational feature of an appliance such as floor care appliance or cleaner 10 wherein one each of a plurality of electro luminescent lights 1530A to 1530F is associated with each of said plurality of switches 1540A to 1540F. The preferred embodiment of the invention is shown in FIG. 9 although there could be a plurality of switches 1540A to 1540$_n$ each associated with one each of a plurality of electro luminescent lights 1530A to 1530$_n$ without affecting the scope of the invention wherein n is the total number of electro luminescent lights and switches. The plurality of switches 1540A to 1540$_n$ are input to microprocessor 1510 through a first bus connector 1570 which connects to a complementary second bus connector 1504. The microprocessor 1510 is provided operating power by a steady DC voltage Vcc and connected to ground 1550. The outputs of the microprocessor 1510 are connected to a plurality of transistors CS1 to CS$_n$ wherein one of each of said transistors CS1 to CS$_n$ is associated with one each of said switches 1540*a* to 1540 F and the associated electro luminescent lights 1530A to 1530F. Note that instead of transistors transistors CS1 to CS$_n$ that one or more relays or other switches could be used to perform the same function. In the preferred embodiment, there are transistors CS1 to CS$_n$.

Each of the electro luminescent lights 1530A to 1530F is supplied AC power from an inverter circuit 1555 which inputs DC power/from Vcc and connected to ground 1550. Upon receiving an input from one of said switches 1540A to 1540F, microprocessor 1510 sends a corresponding output to the associated transistor 1520A to 1520F. In the case where it is desired to illuminate one of the electroluminescent lights 1530A to 1530F, as when a cleaner 10 function or operational feature is turned on for instance, one of switches 1540A to 1540F is pressed which causes current from Vcc to be input to microprocessor 1510. Microprocessor 1510 causes a corresponding output to the associated transistor 1520A to 1520F. When transistor 1520A to 1520F senses the output, it allows AC current to flow from the inverter 1555 to the associated electro luminescent light 1530A to 1530F to ground 1550 and the associated electro luminescent light 1530A to 1530F is illuminated. The associated electro luminescent light 1530A to 1530F remains illuminated until the associated switch 1540A to 1540F is pressed again and the microprocessor 1510 turns of the output to the associated transistor 1520A to 1520F. The microprocessor 1510 also may control the feature of the cleaner 10 the switches 1540A to 1540F and electroluminescent lights 1530A to 1530F are associated with by supplying a corresponding output to another group of transistors controlling the feature. The manner in which the associated operational feature is controlled is not shown and is not part of the invention. The microprocessor 1510 can be programmed in a variety of ways to control the cleaner 10 operational feature that the switches 1540A to 1540F and electro luminescent lights 1530A to 1530F are associated with. For example, it may not be desirous or possible for certain features to be enabled simultaneously so microprocessor 1510 can be programmed to not allow these certain features to be enabled simultaneously. It may also be desired to only operate certain cleaner 10 operational features in a designated sequence which microprocessor 1510 can be programmed to control. There are an infinite number of ways the microprocessor 1510 can be programmed to control the operational features of the cleaner 10 and the illumination of the associated electro luminescent lights 1530A to 1530F according to the input from switches 1540A to 1540F.

It should be clear from the foregoing that the described structure clearly meets the objects of the invention set out in the description's beginning. It should now also be obvious that many changes could be made to the disclosed structure which would still fall within its spirit and purview.

The invention claimed is:

1. A floor care appliance having at least one operational feature, comprised of:

a suction nozzle;

a handle;

at least one electrical switch for controlling the operation of said at least one operational feature; and an electro luminescent light associated with said at least one electrical switch, said light and said associated electrical switch formed as a sheet comprising:

a transparent substrate layer, said substrate layer allowing said electroluminescent light to pass therethrough;

an electroluminescent phosphor layer, said electroluminescent phosphor layer disposed beneath said transparent substrate layer;

a film layer disposed beneath said transparent substrate layer, wherein said electroluminescent phosphor layer is surrounded by a film layer;

an inner capacitive dielectric layer disposed beneath said electroluminescent phosphor layer;

a rear capacitive electrode disposed beneath said inner capacitive dielectric layer;

a first encapsulating dielectric layer, disposed beneath said inner capacitive layer, wherein said first encapsulating dielectric layer surrounds said rear capacitive electrode;

a second encapsulating dielectric layer, disposed beneath said rear capacitive electrode, and said first encapsulating dielectric layer;

a first contact layer disposed beneath said second encapsulating dielectric layer;

a first dielectric layer disposed beneath said second encapsulating dielectric layer, wherein said first dielectric layer surrounds said first contact layer;

a second dielectric layer disposed beneath said first contact layer;

a third dielectric layer disposed beneath said first contact layer, wherein said third dielectric layer surrounds said second dielectric layer;

a second contact layer disposed beneath said second dielectric layer;

a fourth dielectric layer disposed beneath said third dielectric layer, wherein said fourth dielectric layer surrounds said second contact layer; and a third encapsulating dielectric layer disposed beneath said second contact layer.

2. The floor care appliance of claim 1, wherein said at least one electrical switch has an open position and a closed position.

3. The floor care appliance of claim 2, further including a microprocessor which determines whether said at least one electrical switch has been moved from the open position to the closed position and causes said operational feature to be energized or de-energized and said associated electro luminescent light to be lighted or extinguished.

4. The floor care appliance of claim 3, further including a transistor operationally connected to said microprocessor for controlling the flow of current from a current source to said electro luminescent light upon an output signal from said microprocessor.

5. The floor care appliance of claim 4, wherein said current source comprises an inverter to provide AC current.

6. The floor care appliance of claim 3, further including a relay operationally connected to said microprocessor for controlling the flow of current from a current source to said electro luminescent light upon an output signal from said microprocessor.

7. The floor care appliance of claim 6, wherein said current source comprises an inverter to provide AC current.

8. The floor care appliance of claim 1, wherein said sheet forming said at least one electrical switch and said associated electro luminescent light is flexible.

9. The floor care appliance of claim 8, wherein said sheet is mounted on a contoured surface of said handle.

10. A floor care appliance of the type having one or more operational features, a suction nozzle, a motor-fan assembly for generating an airflow originating at the suction nozzle, a handle, a suction conduit fluidly connected at one end to the suction nozzle, and a filtration arrangement fluidly connected to the opposite end of the suction conduit, the improvement comprising:

an electrical switch for controlling each of said one or more operational features; and an electro luminescent light associated with said electrical switch, wherein said electrical switch and said light are formed as a flexible sheet comprising:

a transparent substrate layer, said substrate layer allowing said electroluminescent light to pass therethrough;

an electroluminescent phosphor layer, said electroluminescent phosphor layer disposed beneath said transparent substrate layer;

a film layer disposed beneath said transparent substrate layer, wherein said electroluminescent phosphor layer is surrounded by a film layer;

an inner capacitive dielectric layer disposed beneath said electroluminescent phosphor layer;

a rear capacitive electrode disposed beneath said inner capacitive dielectric layer;

a first encapsulating dielectric layer, disposed beneath said inner capacitive layer, wherein said first encapsulating dielectric layer surrounds said rear capacitive electrode;

a second encapsulating dielectric layer, disposed beneath said rear capacitive electrode, and said first encapsulating dielectric layer;

a first contact layer disposed beneath said second encapsulating dielectric layer;

a first dielectric layer disposed beneath said second encapsulating dielectric layer, wherein said first dielectric layer surrounds said first contact layer;

a second dielectric layer disposed beneath said first contact layer, a third dielectric layer disposed beneath said first contact layer, wherein said third dielectric layer surrounds said second dielectric layer;

a second contact layer disposed beneath said second dielectric layer;

a fourth dielectric layer disposed beneath said third dielectric layer, wherein said fourth dielectric layer surrounds said second contact layer; and a third encapsulating dielectric layer disposed beneath said second contact layer.

11. The floor care appliance of claim 10, wherein said at least one electrical switch has an open position and a closed position.

12. The floor care appliance of claim 11, further including a microprocessor which determines whether said at least one electrical switch has been moved from the open position to the closed position and causes said operational feature to be energized or de-energized and said associated electro luminescent light to be lighted or extinguished.

13. The floor care appliance of claim 12, further including a transistor operationally connected to said microprocessor for controlling the flow of current from a current source to said electro luminescent light upon an output signal from said microprocessor.

14. The floor care appliance of claim 13, wherein said current source comprises an inverter to provide AC current.

15. The floor care appliance of claim 12, further including a relay operationally connected to said microprocessor for controlling the flow of current from a current source to said electro luminescent light upon an output signal from said microprocessor.

16. The floor care appliance of claim 15, wherein said current source comprises an inverter to provide AC current.

17. The floor care appliance of claim 10, wherein said sheet forming said at least one electrical switch and said associated electro luminescent light is flexible.

18. The floor care appliance of claim 17, wherein said sheet is mounted on a contoured surface of said handle.

* * * * *